US012366182B2

(12) United States Patent
Kroos et al.

(10) Patent No.: US 12,366,182 B2
(45) Date of Patent: Jul. 22, 2025

(54) VALUE FOR AN INTERNAL COMBUSTION ENGINE AND PRODUCTION METHOD

(71) Applicant: MAHLE International GmbH, Stuttgart (DE)

(72) Inventors: Peter Kroos, Rutesheim (DE); Alexander Mueller, Metzingen (DE); Alexander Puck, Esslingen (DE); Tobias Wege, Niddatal (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 18/412,990

(22) Filed: Jan. 15, 2024

(65) Prior Publication Data

US 2024/0240577 A1 Jul. 18, 2024

(30) Foreign Application Priority Data

Jan. 16, 2023 (DE) ..... 10 2023 200 287.6

(51) Int. Cl.
*F01L 3/14* (2006.01)
*F01L 3/02* (2006.01)
*F01L 3/20* (2006.01)

(52) U.S. Cl.
CPC *F01L 3/14* (2013.01); *F01L 3/02* (2013.01); *F01L 3/20* (2013.01)

(58) Field of Classification Search
CPC ..... F01L 3/14; F01L 3/02; F01L 3/20
USPC ..... 123/41.16
See application file for complete search history.

(56) References Cited

U.S. PATENT DOCUMENTS 2,395,942 A * 3/1946 Saffady ..... F01L 3/14 29/888.46
2,440,461 A * 4/1948 Clements ..... B23K 31/02 29/888.45
2,548,092 A * 4/1951 Bartlett ..... F01L 3/14 165/104.19
3,362,057 A * 1/1968 Kubera ..... F16K 1/36 29/888.45
3,378,904 A * 4/1968 Prasse ..... F01L 3/14 165/104.19
3,627,521 A * 12/1971 Vordahl ..... B23K 20/04 419/48
3,889,347 A * 6/1975 Villani ..... B22F 3/1134 419/24
4,459,949 A * 7/1984 Weintz ..... F01L 3/14 123/188.2

(Continued)

FOREIGN PATENT DOCUMENTS

DE 3204986 A1 9/1982
JP h03260309 A 11/1991
JP 2014152636 A 8/2014

OTHER PUBLICATIONS

English abstract for JP-2014152636.
English abstract for DE-3204986.
German Search Report for DE-102023200287.6, dated Aug. 30, 2023.

*Primary Examiner* — Kurt Philip Liethen
*Assistant Examiner* — John D Bailey
(74) *Attorney, Agent, or Firm* — Fishman Stewart PLLC

(57) ABSTRACT

A valve for an internal combustion engine and a method for producing such a valve is disclosed. The valve includes a valve bottom and a valve stem projecting from the valve bottom. An interior of the valve delimits a hollow space, in which sodium for cooling is received. In the hollow space, a non-evaporable getter is arranged.

15 Claims, 1 Drawing Sheet

(56) References Cited

U.S. PATENT DOCUMENTS 5,056,219 A * 10/1991 Iwase ..... B21K 1/22 29/888.452
5,111,049 A * 5/1992 Romano ..... F25D 19/006 250/352
5,560,380 A * 10/1996 Hamanaka ..... C22B 26/10 134/152
5,769,037 A * 6/1998 Ohtsubo ..... F01L 3/14 29/888.45
5,833,738 A * 11/1998 Carrea ..... B01D 53/04 95/122
5,972,183 A * 10/1999 Krueger ..... F04B 37/02 118/724
6,077,046 A * 6/2000 Kennedy ..... F04B 37/02 417/48
6,109,880 A * 8/2000 Krueger ..... C23C 14/564 417/51
6,161,285 A * 12/2000 Eberhardt ..... C22F 1/183 29/888.453
6,347,925 B1 * 2/2002 Woodard ..... H01J 41/12 417/51
6,590,332 B1 * 7/2003 Park ..... H01J 11/12 313/484
6,912,984 B2 * 7/2005 Narasimhan ..... F01L 3/14 29/888.45
8,847,373 B1 * 9/2014 Summers ..... H01L 23/26 257/E23.085
9,683,467 B2 * 6/2017 Knudsen ..... F01L 3/02
2002/0145940 A1 * 10/2002 Terentiev ..... H02K 49/106 366/273
2004/0261746 A1 * 12/2004 Narasimhan ..... F01L 3/14 29/888.4
2005/0085053 A1 * 4/2005 Chen ..... H01L 23/26 257/E23.137
2005/0150328 A1 * 7/2005 Mariani ..... C22B 5/18 75/245
2005/0238803 A1 * 10/2005 Tremel ..... H10K 50/8426 257/E23.137
2006/0005792 A1 * 1/2006 Bosler ..... B23K 11/26 123/41.41
2006/0174941 A1 * 8/2006 Cohen ..... G05D 11/138 137/93
2006/0284556 A1 * 12/2006 Tremel ..... H10K 59/874 313/506
2007/0055059 A1 * 3/2007 Miyamoto ..... C01B 3/384 540/30
2007/0125976 A1 * 6/2007 Stark ..... F01L 3/20 251/356
2007/0146965 A1 * 6/2007 Mitchell ..... H01G 11/82 361/502
2007/0215306 A1 * 9/2007 Muramatsu ..... B22D 17/2038 164/113
2007/0266984 A1 * 11/2007 Reinhardt ..... F01L 3/20 123/190.14
2008/0168777 A1 * 7/2008 Atkins ..... F16L 59/065 62/51.1
2009/0065500 A1 * 3/2009 England ..... H01F 41/00 219/623
2009/0236989 A1 * 9/2009 Handa ..... H01J 23/12 315/39.51
2009/0237861 A1 * 9/2009 Peterson ..... H01G 9/08 361/502
2010/0272999 A1 * 10/2010 Baudis ..... C22B 5/04 75/343
2011/0151143 A1 * 6/2011 Ogris ..... H01J 7/183 427/591
2011/0174259 A1 * 7/2011 Yoshimura ..... F01L 3/16 123/188.2
2012/0068300 A1 * 3/2012 Summers ..... H01L 23/26 257/E21.333
2012/0085070 A1 * 4/2012 Chou ..... B65D 81/3825 53/79
2012/0106085 A1 * 5/2012 Yamazaki ..... H01L 23/057 361/767
2012/0112212 A1 * 5/2012 Kim ..... H10K 59/8722 438/28
2012/0132522 A1 * 5/2012 Foster ..... H01L 21/67092 438/118
2012/0132950 A1 * 5/2012 Yamamuro ..... H10K 59/8794 257/40
2012/0199092 A1 * 8/2012 Yagi ..... B23P 15/002 123/188.3
2012/0228538 A1 * 9/2012 Yoshimura ..... F01L 3/00 29/244
2012/0304464 A1 * 12/2012 Morii ..... B21D 53/84 29/888.45
2013/0019474 A1 * 1/2013 Maruyama ..... B21K 1/22 29/888.45
2013/0025584 A1 * 1/2013 Palmieri ..... F24S 40/40 126/634
2014/0145589 A1 * 5/2014 Haag ..... H01J 7/186 313/553
2014/0158113 A1 * 6/2014 Urbano ..... F24S 40/40 126/653
2014/0175590 A1 * 6/2014 Gooch ..... B81B 7/0038 428/161
2015/0249042 A1 * 9/2015 Gooch ..... B32B 15/04 428/195.1
2015/0292640 A1 * 10/2015 Yokoyama ..... C23C 8/28 251/318
2016/0086766 A1 * 3/2016 Takahoko ..... H01J 37/18 250/492.3
2017/0287668 A1 * 10/2017 Yanagisawa ..... H05G 1/30
2018/0144874 A1 * 5/2018 Yin ..... B22F 3/11
2018/0298793 A1 * 10/2018 Karita ..... H05B 6/101
2020/0347756 A1 * 11/2020 Matthias ..... F01L 3/18
2021/0120929 A1 * 4/2021 Victor ..... A45C 11/20
2021/0270154 A1 * 9/2021 Kunitake ..... F01L 3/14
2021/0371958 A1 * 12/2021 Sugiyama ..... B23K 35/0261

* cited by examiner

VALUE FOR AN INTERNAL COMBUSTION ENGINE AND PRODUCTION METHOD

CROSS-REFERENCE TO RELATED APPLICATION

This application claims priority to German Patent Application No. DE 10 2023 200 287.6 filed on Jan. 16, 2023, the contents of which are hereby incorporated by reference in its entirety.

TECHNICAL FIELD

The present invention relates to a valve for an internal combustion engine which comprises a hollow space with sodium for cooling received therein. Further, the invention relates to a method for producing such a valve.

BACKGROUND

Usually, a valve in an internal combustion engine serves for the optional opening and blocking of flows, for example of air, fuel, an air-fuel mixture and exhaust gas. Thus, such a valve is exposed during the operation to elevated temperatures and an aggressive environment. In order to fulfil requirements in terms of the thermal and/or thermo-chemical stability of such a valve, valves are usually produced from metals and/or alloys.

It is known to introduce sodium into a hollow space of such a valve in order to cool the valve during the operation.

The present invention deals with the object of stating for a valve of the type mentioned above, for a method for producing such a valve, improved or at least other embodiments. In particular, the present invention deals with the object of stating for the valve and for the method improved or at least alternative embodiments which are characterised by increased component strength.

According to the invention, this object is achieved through the subjects of the independent claim(s). Advantageous embodiments are subject of the dependent claims.

SUMMARY

The present invention is based on the general idea of additionally introducing a non-evaporable getter in a hollow space of a valve, in which sodium for cooling is received. The getter binds, in particular by means of sorption, foreign constituents present in the hollow space which differ from sodium, which includes hydrocarbons such as oils, greases and the like. Especially, the getter results in binding short-chain hydrocarbons. The knowledge that the said foreign constituents result in an increase of the pressure in the hollow space and a reduction of the cooling achieved by means of the sodium is utilised here. By using the getter in the hollow space and the binding of the foreign constituents thus taking place, both the pressure in the hollow space, i.e. the internal pressure, is reduced and the cycle for cooling the valve performed by the sodium, improved. Besides the directly improved cooling achieved thereby, the reduced internal pressure also results in an improved heat transfer within the hollow space and a further improved cooling. Thus, the valve during the operation has a reduced temperature and a reduced internal pressure, so that the strength of the valve and thus the component strength are increased.

According to the inventive idea, the valve comprises a valve bottom and a valve stem projecting from the valve bottom. In the interior of the valve, the valve delimits a hollow space in which sodium for cooling the valve during the operation is received. In addition, a non-evaporable getter is arranged in the hollow space.

The getter is also familiar to the person skilled in the art as "absorbing material". The non-evaporable getter is also familiar by the English designation "non-evaporable getter" and the abbreviation "NEG".

Preferentially, the getter binds the foreign constituents which are present in particular as gases by means of chemical sorption. As a consequence, the foreign constituents are bonded to the getter with a higher bonding energy. Thus, it is prevented that the foreign constituents during the operation of the valve are again passed on into the hollow space from the getter. Thus, a reliable cooling and a lasting increase of the component strength takes place in this manner.

Advantageously, the valve is employed in an internal combustion engine in order to open and block flows in the internal combustion engine, in particular into an associated cylinder and/or from an associated cylinder.

Practically, the valve bottom interacts with an associated valve seat in order to block and open a corresponding opening.

The adjustment of the valve practically takes place via the valve stem.

To produce the valve, sodium and the non-evaporable getter are introduced into the hollow space of the valve and the hollow space closed.

The order in which sodium and the getter are introduced into the hollow space can be any.

It is conceivable to initially introduce the getter into the hollow space so that the getter is preferentially present in the region of the hollow space facing the valve bottom.

In preferred embodiments, the getter is activated only after the introduction into the hollow space, preferentially additionally after the closing of the hollow space. Thus, the getter is preferentially activated only in particular when it has already been introduced into the hollow space, preferentially in addition, when the hollow space has already been closed. The activation of the getter results in the said bonding of the foreign constituents in the hollow space. Thus, when the getter following the introduction into the hollow space, preferentially in addition after the closing of the hollow space, is activated, the getter exclusively binds foreign constituents present in the hollow space. This means that the saturation limit of the getter is not reached through the bonding of constituents present outside the hollow space. Consequently, a reliable bonding of all foreign constituents or at least an increase of the portion of the bonded foreign constituents is achieved in this manner. This effect is improved/increased by closing the hollow space prior to the activation. Thus, less getter is ultimately required in this way, wherein at the same time the said improved cooling and increased component strength are attained.

In preferred embodiments, the getter comprises a metal base. This means in particular that the main constituent of the getter is a metal. Thus, the non-evaporable characteristic of the getter can be more easily achieved.

Preferentially, the getter comprises a zirconium base. Besides the said non-evaporable characteristic, the zirconium base results in an increased temperature resistance of the getter so that a reliable bonding of the foreign constituents is achieved even during the operation of the valve. Thus, the improved cooling and increased component strength are provided even at elevated operating temperatures of the valve, so that the valve can be employed altogether in a greater operating temperature range. In addition, the use of zirconium as base results in a cost reduction, in particular compared with getters having a titanium base.

Advantageously, besides the metal base, in particular the zirconium base, the getter also comprises further components of metal. In preferred embodiments, the getter comprises vanadium and/or titanium.

Particularly preferably, the getter comprises a zirconium base as well as vanadium and titanium. In particular, the getter consists of the zirconium base as well as vanadium and titanium. Besides the described increase of the possible operating temperatures of the valve, this leads to an improved binding of the foreign constituents and an increase of the saturation limit of the getter. Altogether, more foreign constituents at simultaneously increased possible operating temperatures are bonded in this manner. Consequently, the cooling is further improved and the component strength further increased.

Preferred are embodiments, in which the getter is present in the form at least of a contiguous body, i.e. as at least a getter piece. Thus, the getter preferably consists of at least one getter piece. This results in a simplified handling and thus simplified production of the valve. In addition to this, a more reliable bonding of the foreign constituents takes place in this manner, so that the cooling is further improved and the component strengths further increased.

In particular, the getter is present as a single getter piece; the getter thus consists of a single getter piece.

Preferably, a body forming the valve later on is provided for producing the valve, which in the following is also referred to as starting body. The starting body comprises the valve bottom of the valve. In addition, the starting body comprises a portion projecting from the valve body, which at least partially forms the valve stem of the valve. In the following, the portion is also referred to as stem portion. The starting body delimits in its interior a hollow space which extends into the stem portion. On the side facing away from the valve bottom, the hollow space is open via the stem portion, i.e. comprises an opening that is open towards the outside, which in the following is also referred to as stem opening. For producing the valve, sodium and the getter are introduced into the hollow space via the stem opening and the stem opening subsequently closed with a closure.

It is likewise conceivable to introduce sodium and/or the getter into the hollow space via the valve bottom. For this purpose, the starting body can comprise in or on the bottom an opening also referred to as bottom opening in the following. Sodium and/or the getter are/is introduced into the hollow space via the bottom opening and the bottom opening then closed. The closing of the bottom opening can take place by means of press-fit stemming of a closure body and subsequent welding.

Preferably, the activation of the getter takes place after the closure of the hollow space.

Preferably, the getter is initially introduced into the hollow space and subsequently sodium.

In preferred embodiments, the closing of the stem opening by means of the closure takes place through a welded connection. The closure and the stem portion are thus welded together. Thus, a reliable and fluid-tight sealing of the hollow space with increased temperature resistance at the same time takes place.

Advantageously, the valve, after the closure of the stem opening, is heat-treated for balancing the microstructure that was changed by the welding. This means that the changes in the microstructure of the valve that occurred because of the increased temperature that occur during the welding are in particular balanced with the heat treatment, in particular at least partially reversed. In this way, the mechanical stability of the valve and thus the component strength are further increased.

Preferentially, the activation of the getter takes place during the said heat treatment for balancing the changed microstructure. This means that both the balancing of the changed microstructure and also the activation of the getter take place during the same process for producing the valve. This results in a substantial simplification of the valve production.

The activation of the getter during the heat treatment for balancing the changed microstructure is achieved in particular in that the getter has a zirconium base.

Preferably, the getter is passivated before being introduced into the hollow space. The passivation of the getter prevents that the surface of the getter is covered and/or occupied, or such an occupation is at least reduced. Only through the subsequent activation is the passivation cancelled, so that the getter binds the said foreign constituents in the hollow space.

The passivation of the getter advantageously takes place by means of the forming of oxides and/or carbides and/or nitrites on the surface of the getter by means of physisorption. This physisorption is broken/dissolved upon the activation of the getter so that the getter binds the said foreign constituents in the hollow space.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
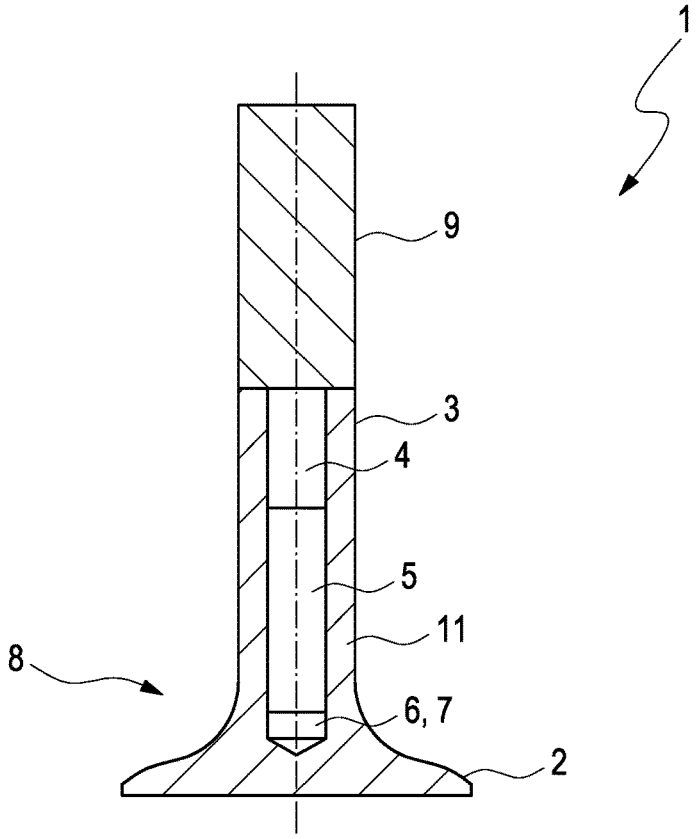
FIG. 1 a section through a valve.

A valve 1, as is exemplarily shown in FIG. 1, is employed in an internal combustion engine which is not shown. In the internal combustion engine, flows, for example into a cylinder and/or out of a cylinder, are blocked and opened with the valve 1. The valve 1 comprises a valve bottom 2 and a valve stem 3 projecting from the valve bottom 2. In the interior of the valve 1, a hollow space 4 is delimited. In the shown exemplary embodiment, the hollow space 4 substantially extends merely through the valve stem 3. In the hollow space 4, sodium 5 is received for cooling the valve 1 during the operation. In addition, a non-evaporable getter 6, also referred to as "non-evaporable getter" or briefly "NEG" is additionally arranged. In the shown exemplary embodiment, the getter 6 comprises a metal base of zirconium, i.e. a zirconium base. In addition, the getter 6 in the shown exemplary embodiment comprises vanadium and titanium. As is evident, further, from FIG. 1, the getter 6 in the shown exemplary embodiment consists of a single contiguous body 7, which in the following is also referred to as getter piece 7.

Figure 2:
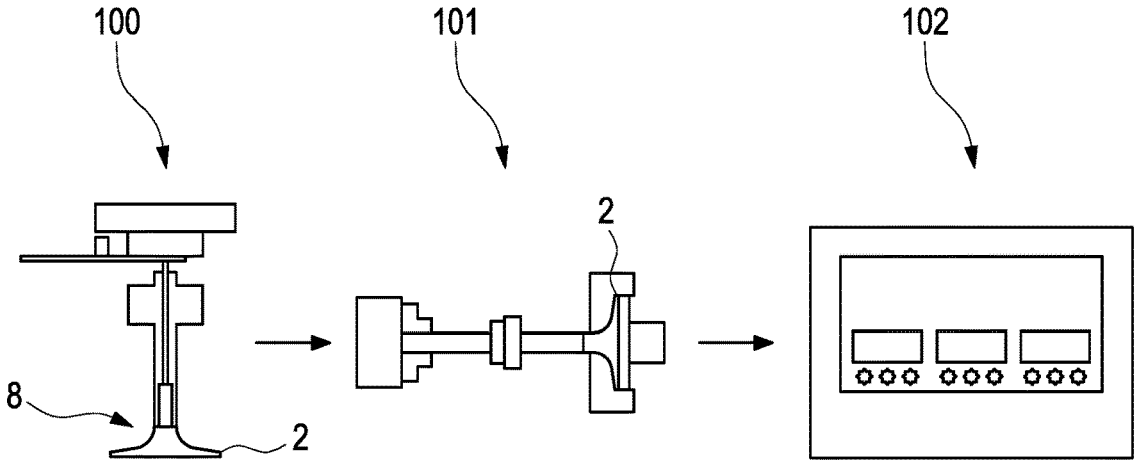
FIG. 2 greatly simplified representations of measures for producing the valve.

FIG. 2 shows simplified representations during the production of the valve 1. There, sodium 5 and the getter 6 are introduced into the hollow space 4, the hollow space 4 closed and the getter 6 activated.

In the shown exemplary embodiment, sodium 5 and the previously passivated getter 6 are introduced into the hollow space 4 in a first measure 100. In the shown exemplary embodiment, initially the getter 6 and subsequently sodium 5 are introduced into the hollow space 4. Thus, the getter piece 7 is arranged in the representation of FIG. 1 on the side of the hollow space 4 facing the valve bottom 2. As is evident from FIG. 1, this is effected in such a manner that the hollow space 4, following the introduction of the getter 6 and of the sodium 5, remains partially free. In the following, the method measure 100 is also referred to as filling measure 100.

As is evident in particular from FIG. 1, a starting body 8 and a closure 9 are provided for producing the valve 1. The starting body 8 comprises the valve bottom 2 of the valve 1 and a stem portion 11 projecting from the valve bottom 2, which partially forms the valve stem 3. The starting body 8 comprises the hollow space 4 and is open on the side facing away from the valve bottom 2 via an opening 10 of the stem portion 11, which in the following is also referred to as stem opening 10. Thus, the hollow space 4 is accessible via the stem opening 10 of the stem portion 11. The getter 6 and sodium 5 are introduced into the hollow space 4 via the stem opening 10. This means that in the filling measure 100, the getter 6 and sodium 5 are introduced into the starting body 8. As is evident from FIG. 2, the hollow space 4 is subsequently closed with the closure 9 in a method measure 101. In the shown exemplary embodiment, the stem opening 10 is closed with the closure 9 in the method measure 101. In the following, the method measure 101 is also referred to as closure measure 101. For closing, the stem portion 11 and the closure 9 are welded to one another in the shown exemplary embodiment. As is indicated in FIG. 2, the closure 9 and the stem portion 11 can be welded together in the closure measure 101 by means of friction welding. In a subsequent method measure 102, the valve 1 thus produced is heat-treated. In the following the method measure 102 is also referred to as heating measure 102. The temperature adjusted in the heating measure 102 and the duration of the heating measure 102 are such that changes in the microstructure of the valve that occur during the welding are partially balanced. During the heating measure 102, the getter 6 is activated at the same time. This means that at the temperatures and duration adjusted for balancing the changed microstructure, the activation of the getter 6 takes place at the same time. Thus, a separate production measure for activating the getter 6 is not required.

With the valve 1 according to the invention and the associated production method, foreign constituents present in the hollow space 4, in particular hydrocarbons and air-gases, for example nitrogen, oxygen, etc. are bonded on the getter 6, preferentially by means of chemical sorption. This results in a reduced internal pressure in the valve 1 and thus, besides an improved cooling, in an increased strength of the valve 1.

The invention claimed is:

1. A valve for an internal combustion engine, comprising:
a valve bottom and a valve stem projecting from the valve bottom,
an interior that delimits a hollow space, in which sodium for cooling is received,
wherein in the hollow space a non-evaporable getter is arranged,
wherein the getter is a single contiguous body arranged on a side of the hollow space facing towards the valve bottom, and
wherein the getter has a zirconium base and further includes vanadium and/or titanium.

2. The valve according to claim 1, wherein following the introduction into the hollow space, the getter is activated.

3. The valve according to claim 2, wherein the getter has a passivation layer comprising oxides and/or carbides and/or nitrites prior to activation.

4. The valve according to claim 1, wherein the getter has a physisorption passivation layer.

5. The valve according to claim 1, wherein the getter includes both of the vanadium and the titanium.

6. A method for producing a valve, comprising:
introducing sodium and a non-evaporable getter in the form of a single contiguous body into a hollow space of the valve, wherein the getter is introduced initially and then the sodium such that the getter is arranged in the hollow space on a side facing a valve bottom,
closing the hollow space,
activating the getter, and
wherein the getter has a zirconium base and further includes vanadium and/or titanium.

7. The method according to claim 6, further comprising:
providing a starting body,
the starting body comprises a valve bottom of the valve and a valve stem of the valve projecting from the valve bottom at least partially forming a stem portion;
the starting body comprising the valve bottom and the valve stem delimits a hollow space, which extends into the stem portion and on the side facing away from the valve bottom is open towards an outside via a stem opening;
wherein the getter and the sodium are introduced via the stem opening into the hollow space, and
closing the hollow space includes closing the stem opening with a closure.

8. The method according to claim 7, wherein the closure and the stem portion are welded to one another.

9. The method according to claim 8, wherein:
the valve after the closing of the stem opening is treated with heat for balancing the microstructure changed through the welding, and
during the heat treatment the getter is activated at the same time.

10. The method according to claim 6, wherein the getter is passivated before being introduced into the hollow space by forming oxides and/or carbides and/or nitrites on a surface of the getter via physisorption.

11. The method according to claim 6, wherein the getter further includes both of the vanadium and the titanium.

12. The method according to claim 6, wherein the getter is activated following closing the hollow space.

13. An internal combustion engine, comprising:
a valve, the valve including:
a valve bottom and a valve stem projecting from the valve bottom;
the valve having an interior that delimits a hollow space; and
wherein a non-evaporable getter is arranged in the hollow space;

wherein the getter is a single contiguous body arranged in the hollow space on a side facing the valve bottom; and wherein the getter has a zirconium base and further includes vanadium and/or titanium.

14. The internal combustion engine according to claim 13, wherein the hollow space further includes sodium arranged therein.

15. The internal combustion engine according to claim 13, wherein the getter further includes both of the vanadium and the titanium.

* * * * *